US005852903A

United States Patent [19]

Astrizky

[11] Patent Number: 5,852,903

[45] Date of Patent: Dec. 29, 1998

[54] HURRICANE PROTECTION ASSEMBLY FOR WINDOWS OR DOORS

[76] Inventor: Isaac Astrizky, 15034 SW. 298 Ter., Leisure City, Fla. 33033

[21] Appl. No.: 802,395

[22] Filed: Feb. 18, 1997

[51] Int. Cl.[6] ..... E06B 3/26

[52] U.S. Cl. ..... 52/202; 49/63; 49/67

[58] Field of Search ..... 49/61, 63, 67, 49/50; 52/106, 107, 202

[56] References Cited

U.S. PATENT DOCUMENTS

| | | | |
|---|---|---|---|
| 353,037 | 11/1886 | Peters | 49/63 |
| 2,091,706 | 8/1937 | Flint | 49/67 |
| 3,020,951 | 2/1962 | Graulich | 49/63 |
| 3,183,547 | 5/1965 | Bury | 49/67 |
| 4,384,436 | 5/1983 | Green | 52/202 |
| 5,457,921 | 10/1995 | Kostrzecha | 52/202 |
| 5,487,243 | 1/1996 | Hale et al. | 52/202 |
| 5,524,403 | 6/1996 | Fullwood | 52/202 |
| 5,603,190 | 2/1997 | Sanford | 52/202 |

*Primary Examiner*—Christopher Kent
*Assistant Examiner*—Timothy B. Kāng
*Attorney, Agent, or Firm*—Malloy & Malloy, P.A.

[57] ABSTRACT

A hurricane shutter for a building opening closure having a window or door frame recessed from the outer face of the building a predetermined depth-wise distance, the shutter being composed of a pair of normally open doors swingable to a closed position with the doors normally flush with the outer face of the building and spanning the opening and a grid-like structure in the recess between the doors, when closed, and the recessed window or door frame to which the doors are releasably locked.

19 Claims, 2 Drawing Sheets

HURRICANE PROTECTION ASSEMBLY FOR WINDOWS OR DOORS

FIELD OF THE INVENTION

There have been numerous types of protective devices for building openings, especially in hurricane prone areas. This invention is of such a device. It is decorative and it provides protection against looters in the event that the building occupant is not in town before or after a hurricane strikes. The device is a shutter providing protection at all times when the shutter doors are closed.

PRIOR RELATED ART

As is conventional, buildings have window and door openings which are spanned by closures, such as a) a door or a window b) fitted and hingedly connected to a companionate frame. To install most hurricane shutters currently on the market, numerous holes are usually required in the building about each building opening and then the opening is spanned by numerous horizontal or vertical members which are screwed into these holes in the wall with accompanying reinforcing rods and the like. Such shutters are not intended to remain on a building all year long; they are not decorative; they most often need to be installed in a hurry; they have been found to have insufficient strength to withstand the impact of many flying objects; they offer little protection from looters following a hurricane; and they must be removed and stored when not in use since they obstruct the windows and doors.

Summary Of The Invention

This invention is of a strong and durable hurricane protection window/door device. Conventionally, windows and doors are recessed in their respective openings depth-wise from the outer building surface toward the inner face of the building. This forms a depth-wise recess or pocket in the outer building surface between the bottom, side and top walls of the opening, which is usually about 3 ¼" in depth. This recess or pocket is utilized in installing the invention.

This invention is of a hurricane shutter composed of a pair of doors which are companionately sized and shaped to just nest within the recess or pocket of a building opening, when closed, in protective covering relation to the associated window or door. They are secured to the walls of the building with the outer face of the shutter, when the shutter is open, being generally flush with the outer surface of the building along each side of the opening. Also, in the recess, spanning each building opening, a relatively deeply recessed sturdy grid-like structure is provided. It is preferably of laterally extending spaced upper, lower and intermediate bars of angle iron. When the shutter doors are closed in to co-planar relation nested within the recess, and the shutters have been connected to the grid-like structure, swinging movement of the doors is prohibited so that they remain in protective covering relation of the building opening.

The shutter may remain installed on a building at all times since it is decorative. In the event of a person leaving their house for an extended period of time or the approach of a hurricane, the pair of each shutter doors of each opening is simply hingedly moved from the open position on the outside surface of the building into the nested position in the associated recess or pocket covering each building opening while abutting and being connected to the grid-like structure.

More particularly, the shutter is composed of two door-like members which are hingedly connected to opposite sides of a building opening such that, when the shutter is opened, see FIG. 1, one face of each of the shutter doors overlays the building just outboard of the sides of each opening so as not to interfere with the opening and closing of the associated window or door. In other words, no portion of either shutter door projects into the view through the opening so that operation of the window or door may take place and light is not obstructed.

In a preferred embodiment, the shutter doors will each have a frame preferably of yellow pine spanned by a firm, strong, durable material, which may be transparent or opaque, such as a panel of polycarbonate material, also known in the trade as HYSOD, a trademark of DSM Engineering Plastic Products, Inc. of Sheffield, Mass.

Generally, the components of the hingedly connected shutter doors, are firmly secured to the building when in the open position in which they do not obstruct normal operation of the window or door, which remain fully operational. On the other hand, when the shutter doors are closed, they protectively cover the building opening and are secured in covering relation by durable fastener means to connect them to the building and the grid-like structure, as will be described more fully hereinafter. This provides protection against intruders and looters, especially after a hurricane. The grid-like support structure against which the hurricane doors abut, when closed, provides rigidifying means and guards against impacts or efforts to open the doors.

Thus, the shutters, once installed, will remain in place and all that the occupant need do when leaving the building for an extended period of time is to hingedly close the shutters and secure them in the closed position. In this position, they very much resemble normal windows. Thereafter, if there is a hurricane while he is at home, or away, the home will be protected from impacts during the hurricane; and, thereafter, from looters which are all too common in the case of a hurricane when an occupant does not have time to return to protect his property during the aftermath.

It is, accordingly, an object of this invention to provide an improved hurricane shutter of the type described hereinafter for the purposes specified.

In accordance with this general object the invention in preferred embodiments will be described on reference to the accompanying drawings.

DETAILED DESCRIPTION OF THE ILLUSTRATED PREFERRED EMBODIMENT

Figure 1:
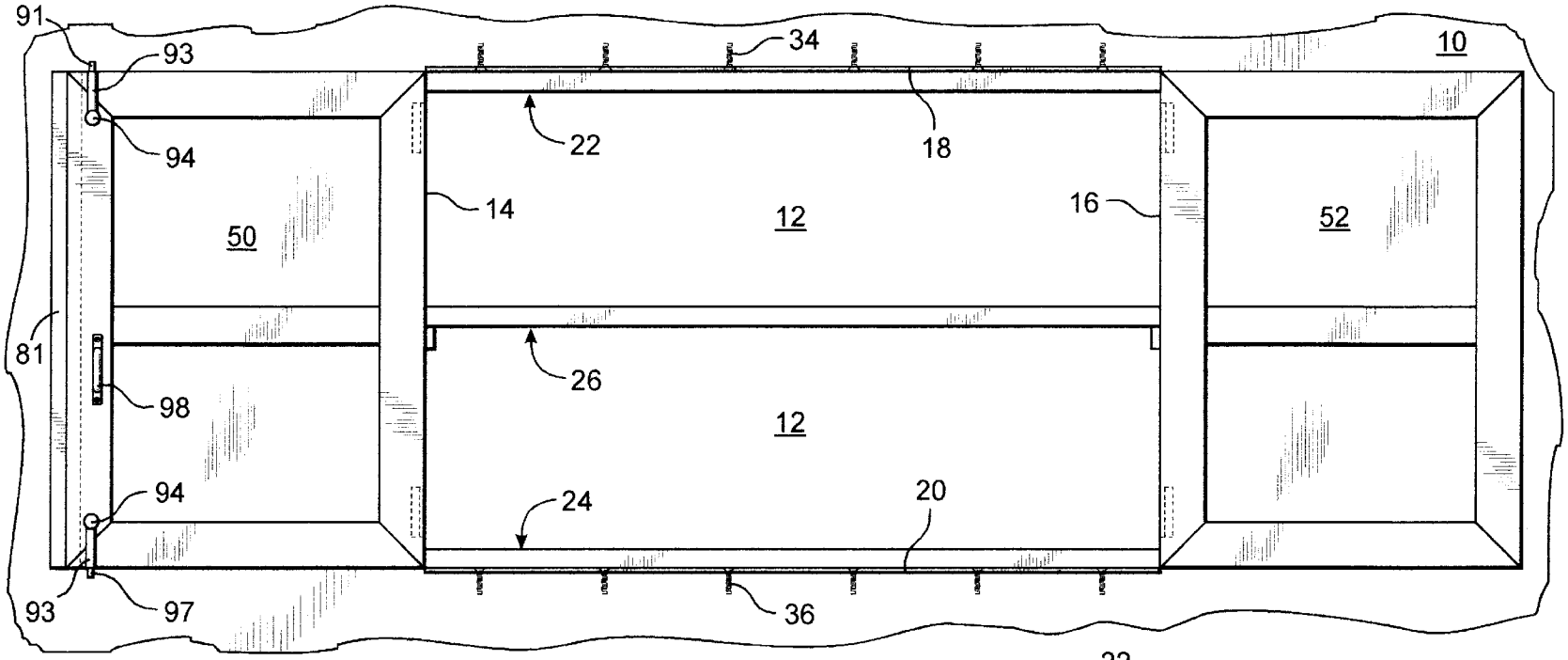
FIG. 1 is an elevation view of the decorative and protective hurricane shutter for a building opening, which opening is spanned by a unit composed of a) a window or door and b) hingedly or pivotally connecting the same to a frame; the hurricane cover is shown in an open position wherein it does not restrict normal operation of the window or door.

Referring to the drawings, wherein like reference characters designate like or corresponding parts throughout the several views, there is shown a decorative and protective hurricane cover. It can be installed on a building surface 10 on opposite sides of either a door or a window. Once installed on a building surface 10, it does not cover any portion of the building opening 12; and the surface of each door of the shutter is generally flush with the outer surface of the building. The opening 12 has depth-wise extending side walls 14, 16, a top wall 18, and a bottom wall 20. These walls are shown in elevation and accordingly appear as lines in FIG. 1.

The side walls of the building opening are spanned by a grid-like structure recessed from the outer surface of the building. The grid-like structure forms an abutment or stop surface. This grid structure is composed lateral members which, in the illustrated embodiment, are an upper, lower and intermediate stop member 22, 24 and 26 secured in spanning relation of the side walls of the building opening.

Figure 2A:
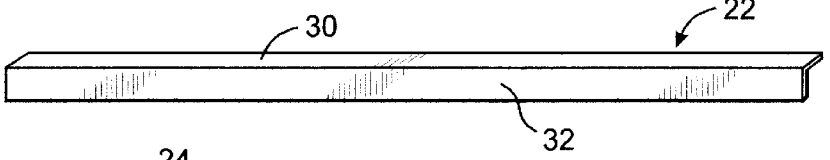
FIG. 2*a* is a perspective view of one of the members of a grid-like structure; it is a top stop in the form of an angle iron; it is also seen at the top central portion of FIG. 1 spanning the top wall of the building opening and recessed within the building opening between the side walls of the opening and secured to the top wall of the opening.
Figure 2B:
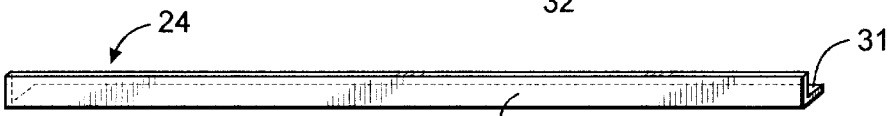
FIG. 2*b* is a perspective view of another of the members of the grid-like structure, a bottom stop in the form of an angle iron.
Figure 2C:
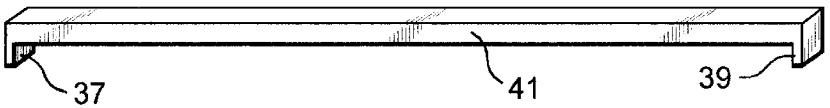
FIG. 2*c* a perspective view of an intermediate stop.
Figure 3:
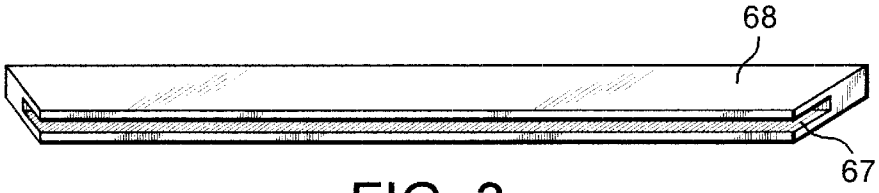
FIG. 3 is a perspective view of one segment of a peripheral frame of one of a pair of shutter doors.

The individual members of the grid-like structure are seen in FIGS. 2*a*, 2*b*, and 2*c*. The top and bottom stop members 22 and 24 are sized to extend between the side walls spanning the opening; and each includes right angularly disposed flanges 30 and 32 in the case of the top one and 31 and 33 in the case of the bottom one. See FIGS. 2*a* and 2*b*, respectively. The flanges of the top and bottom stop members are each about ⅛" thick and the outside face of each flange extends from their line of juncture about 1½".

In assembly, one of the flanges 32 of the top stop member 22 and one of the flanges 33 of the bottom stop member 24 extend vertically in confronting relation and co-planar relation defining a plane of abutment which is recessed from the outer building surface about 1½". This dimension will accommodate the thickness of the shutter door so that, when they are recessed in the building opening, the inner face of the shutter doors are in confronting and abutting relation to the grid-like structure and the outermost surface of the doors are flush with the building face.

In assembly, the flange 30 of the top stop member and the flange 31 of the bottom stop member extend horizontally and each are secured to the top and bottom walls 18 and 20 of the building opening respectively, preferably by 3"×¼" Topcon screws, six in number, spaced uniformly from one another. These are designated by the numerals 34 and 36 in the drawings.

For further grid abutment surface structure, a center stop or intermediate grid member 26 for the grid-like structure may be employed, see FIG. 2*c*. It is also composed of a right angle length of bar with the addition of an end plate 37 and 39 welded on each end. The intermediate stop member is positioned with one of its flanges 41 extending vertically in the abutment plane of the vertical flanges of the top and bottom stop members. The end plates are secured to the side walls of the building opening with Topcon screws in the preferred embodiment.

It is seen that these members provide a strong, secure grid-like structure and abutment surfaces for the hurricane shutter doors when they are moved into co-planar relation with one another, recessed so that their outer surfaces are flush with the outer building surface, and their inner surface confronts and abuts the outer surface of the grid-like structure. This provides strong, underlying support against inwardly and outwardly directed forces on the shutter members now to be described. When they are nested in the building opening in a closed and locked position, locked to the grid-like structure, they cannot be swingably opened or closed out of their co-planar relation as shown in FIG. 4.

Figure 4:
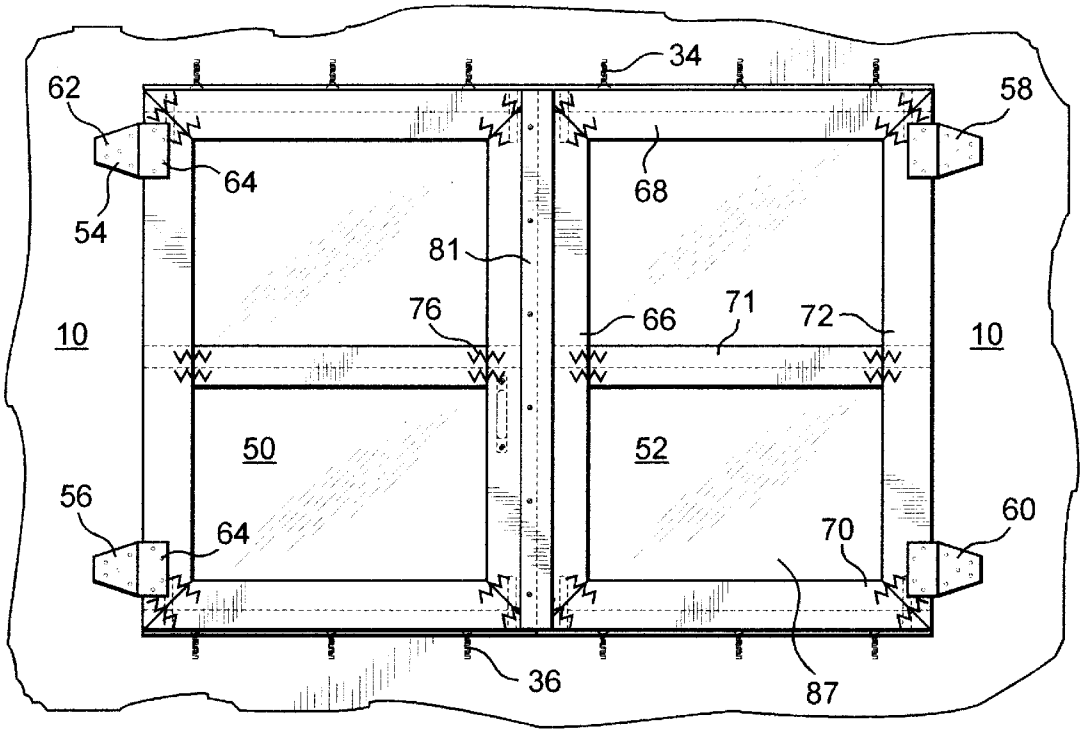
FIG. 4 is an elevation view of the shutter in closing relation of a building opening.

In FIG. 4, the shutter is seen to be composed of two doors 50 and 52. These doors are sized to mate and just cover the building opening with their outer surface being flush with the building. The outer surface of each door is hingedly connected to the outer surface of the building by secure hinges 54, 56, 58 and 60. Preferably, 3½"×¼" screws are used to connect the hinges such as those designated by the numerals 62 and 64.

In a preferred embodiment, as shown, each door, such as that designated by the numeral 52, may be composed of four mitered interconnected pieces of yellow pine, each with a 1½" deep groove 67 in their respective interconfronting faces, see at 66, 68, 70 and 72. Each door may be provided with an intermediate lateral member, such as 71, the member being fastened to the door with corrugated fasteners such as that indicated by the numeral 76.

In a preferred embodiment, a clear panel 87 of polycarbonate Engineering Plastics Products, Inc., is fitted in the grooves to provide a durable door. In a preferred embodiment, the groove of the frame members of the door extends depth-wise 1½" and the yellow pine is 1½" thick. The total overall thickness of the peripheral frame members of the door are 3½" from the innermost surface to the outermost surface. Also, 3"×⅝" dowels are utilized at the corners for securing the door members together in a conventional manner with the exception that the size and strength of these dowels provides for great strength.

Along the edge of one of the pair of doors which meets in the middle with the other of the pair of doors there is provided a flat iron bar 81 preferably 1½"×⅛". This iron bar extends completely along the edge of one of the doors with half of it being secured to the door by screws and the other half extending outwardly. The bar, when in the closed position, as seen in FIG. 4, has one-half which covers the adjacent margin of the other of the doors.

The inside surface of the door 50, see FIG. 1, at the left-hand side has two locking devices respectively including a spring urged pin 91 and 97 biased into an extended position from respective captivating cylinders 93, the pins being provided with a ring 94 so that it can be pulled down in the case of the pin, 91 or up or in the case of the pin 97. The door also has a handle 98 so that the door can be pulled into the closed position while the pair of pins 91 and 97 are pulled toward one another until the door has been closed whereupon the pins are released and trapped behind the vertical outermost stop members of the grid-like structure. This door cannot be pried open thereafter. Thus, when the doors are closed, as shown in FIG. 4, the door 52 cannot be moved open because of the side mounted plate or bar 81 on the door 50 and similarly the door 50 cannot be pried open by reason of the pins 91 and 27 being captivated behind the members of the grid-like structure.

Generally speaking, windows and doors are not necessarily of standard size, however, each manufacturer usually has a line of several sizes and styles. It will be appreciated that, when a window unit is sold, the purchaser may be given the option to also purchase a kit composed of the doors, grid-like structure members and the hardware, fasteners, etc. For installing this invention.

It will be apparent that when the doors are open, any suitable means such as a releasable hook may be provided on each door to releasably connect to an eye in the building to hold them in an open decorative position.

While this invention has been shown and described in what is considered to be a practical and preferred embodiment, it is recognized that departures may be made within the spirit and scope of this invention which is therefore not to be limited except as set forth in the claims and within the doctrine of equivalents.

Now that the invention has been described,

What is claimed is:

1. A protection assembly for a window unit or door unit mounted within a recess opening of a building, said protection assembly comprising:

(a) a pair of doors movably attached to an outer surface of the building and selectively movable between an opened position and a closed position, (b) a grid-like structure attached to the building within the opening and in inwardly spaced relation to the outer surface thereof, (c) said grid-like structure including a plurality of elongated stop members including at least a top stop member and a bottom stop member each horizontally oriented in spaced relation to one another and in spanning relation across the opening, (d) each of said top and bottom stop members comprising two integrally connected flanges disposed in substantially perpendicular relation to one another and extending continuously along the length of each of said stop members, (e) a lock assembly mounted on at least one of said doors and including at least one lock device having a lock element disposable behind an outermost one of said flanges of one of said top and bottom stop members when said doors are in said closed position, (f) said closed position defined by said doors being co-planar and disposed in abutting engagement with said top and bottom stop member and in overlying, covering relation to the unit, and (g) said open position defined by spaced, substantially co-planar relation of said pair of doors, each door disposed on an opposite side of the opening.

2. An assembly as in claim 1 wherein said closed position is further defined by each of said pair of doors including an inner surface disposed in abutting engagement with said top and bottom stop members and an outer surface disposed in substantially co-planer relation with one another and with an outer surface of the building.

3. An assembly as in claim 1, further comprising an elongated cover plate fixedly secured to an outer surface of said one door along a length of one peripheral edge thereof, said cover plate dimensioned and configured to extend laterally outward from said one peripheral edge in overlying relation to a correspondingly, adjacently positioned peripheral edge of the other of said doors, when said pair of doors are in said closed position.

4. An assembly as in claim 1 wherein said plurality of elongated stop members of said grid-like structure further includes an intermediate stop member horizontally oriented in spaced relation between said top and bottom stop members and in spanning relation across the opening, said intermediate stop member including an outermost flange disposed in substantially aligned relation with an outermost flange of each of said top and bottom stop members.

5. An assembly as in claim 4 wherein said closed position is further defined by each of said pair of doors including an inner surface disposed in abutting engagement with said outermost flanges of each of said top, bottom and intermediate stop members.

6. An assembly as in claim 5 wherein said top stop member is disposed in spanning relation across an upper periphery of the opening and said bottom stop member is disposed in spanning relation across a lower periphery of the opening.

7. An assembly as in claim 6 wherein said intermediate stop member is substantially equally spaced between said top and bottom stop members and disposed in spanning relation across a substantial mid-point of the opening.

8. An assembly as in claim 4 wherein said intermediate stop member comprises two integrally connected flanges disposed in substantially perpendicular relation to one another and extending continuously along the length of said intermediate stop member.

9. An assembly as in claim 4 wherein each of said pair of doors comprises a rigid central panel and a frame structure connected to said rigid central panel and disposed and configured to substantially define the peripheral boundaries of each door.

10. An assembly as in claim 9 wherein said frame structure of each door comprises a plurality of interconnecting frame sections collectively defining a continuous periphery of said door, each frame section including a groove integrally formed along a length thereof and extending inwardly into the interior thereof from an inner peripheral edge; each groove of each frame section disposed and dimensioned for secured, enclosing relation to an outer peripheral edge of said rigid central panel.

11. An assembly as in claim 10 wherein said plurality of frame sections of each door are fixedly interconnected to one another at correspondingly positioned ends thereof and are collectively secured to said central rigid panel in surrounding relation thereto.

12. An assembly as in claim 11 further comprising a hinge assembly mounted on the outer surface of the building and pivotally attaching each of said pair of doors to the building for swinging movement thereof between said open and closed positions.

13. A protection assembly for a window unit or door unit mounted within a recess opening of a building, said protection assembly comprising:

(a) a pair of doors each including an inner surface and an outer surface and being swingably attached to an outer surface of the building on opposite sides of the opening and selectively moveable between an opened position and a closed position, (b) a grid-like structure fixedly attached to the building within the opening and in inwardly spaced relation to the outer surface thereof, (c) said grid-like structure including a top stop member, a bottom stop member and an intermediate stop member disposed in spaced relation to one another and each having an elongated configuration and being horizontally oriented in spanning relation across the opening, (d) each of said top and bottom stop members comprising two integrally connected flanges disposed in substantially perpendicular relation to one another and extending continuously along a length of each of said stop members, (e) a lock assembly mounted on at least one of said doors and including at least two lock devices each having a lock element disposable behind an outermost one of said flanges of a different one of said top and bottom stop members when said doors are in said closed position, (f) an elongated cover plate fixedly secured to an outer surface of one of said doors along a length of one peripheral edge thereof, said cover plate dimensioned and configured to extend laterally outward from said one peripheral edge in overlying relation to a corresponding, adjacently positioned periperal edge of the other of said doors, when said pair of doors are in said closed position, (g) said closed position defined by said doors being co-planar and collectively disposed in overlying, covering relation to the unit and each door having said inner surface concurrently disposed in abutting engagement with said intermediate stop member and said outermost flanges of said top and bottom stop members, and (h) said opened positioned of said pair of doors defined by spaced, co-planar relation of said pair of doors, each door disposed on an opposite side of the opening.

14. An assembly as in claim 13 wherein each of said pair of doors comprises a rigid central panel and a frame structure connected to said rigid panel and disposed and configured to substantially define the peripheral boundaries of each door.

15. An assembly as in claim 14 wherein said frame structure of each door comprises a plurality of interconnected frame sections collectively defining a continuous periphery of said door, each frame section including a groove integrally formed along a length thereof and extending inwardly into the interior thereof from an inner peripheral edge, each groove of each frame section disposed and dimensioned for secured, enclosing relation to an outer peripheral edge of said rigid central panel.

16.An assembly as in claim 14 wherein each of said rigid panels is formed of plastic material.

17.An assembly as in claim 14 wherein each of said rigid panels is formed of opaque material.

18.An assembly as in claim 14 wherein each of said rigid panels is formed of transparent material.

19. An assembly as in claim 14 wherein each of said rigid central panels is formed of polycarbonate material.

* * * * *